US007810457B2

(12) United States Patent
Blassnitz et al.

(10) Patent No.: US 7,810,457 B2
(45) Date of Patent: Oct. 12, 2010

(54) SYSTEM AND METHOD FOR CONTROLLING OIL TEMPERATURE OF AN INTERNAL COMBUSTION ENGINE IN A MOTOR VEHICLE

(75) Inventors: Timo Blassnitz, Obersulm (DE); Oliver Wiech, Schwieberdingen (DE)

(73) Assignee: Daimler AG, Stuttgart (DE)

( * ) Notice: Subject to any disclaimer, the term of this patent is extended or adjusted under 35 U.S.C. 154(b) by 338 days.

(21) Appl. No.: 11/793,524

(22) PCT Filed: Dec. 2, 2005

(86) PCT No.: PCT/EP2005/012935

§ 371 (c)(1),
(2), (4) Date: Mar. 28, 2008

(87) PCT Pub. No.: WO2006/066713

PCT Pub. Date: Jun. 29, 2006

(65) Prior Publication Data

US 2009/0107424 A1 Apr. 30, 2009

(30) Foreign Application Priority Data

Dec. 21, 2004 (DE) ..... 10 2004 061 426

(51) Int. Cl.
*F01P 11/08* (2006.01)

(52) U.S. Cl. ..... 123/41.33; 123/196 AB

(58) Field of Classification Search ..... 123/41.33, 123/196 AB
See application file for complete search history.

(56) References Cited

U.S. PATENT DOCUMENTS 4,977,862 A * 12/1990 Aihara et al. ..... 123/41.12
5,215,044 A 6/1993 Banzhaf et al.
6,053,131 A 4/2000 Mueller et al.
6,382,144 B1 5/2002 Schneider
6,668,764 B1 * 12/2003 Henderson et al. ..... 123/41.33

(Continued)

FOREIGN PATENT DOCUMENTS

DE 766 237 4/1952
DE 41 04 093 A1 8/1992
DE 197 15 324 A1 10/1998

(Continued)

OTHER PUBLICATIONS

European Patent Application 0323212, published Jul. 5, 1989.*

(Continued)

*Primary Examiner*—Noah Kamen
(74) *Attorney, Agent, or Firm*—Crowell & Moring LLP

(57) ABSTRACT

A system and method for controlling the temperature of the engine oil of an internal combustion engine of a motor vehicle are provided. The system includes an engine oil circuit for controlling the temperature of the engine oil, which engine oil circuit includes the internal combustion engine and a coolant/engine-oil heat exchanger; and a coolant circuit for controlling the temperature of the internal combustion engine, which coolant circuit in a main branch, includes the internal combustion engine, a coolant cooler and a first coolant pump and, in an auxiliary branch downstream of the coolant cooler, includes the coolant/engine-oil heat exchanger and a second coolant pump. The heat of the engine oil can thereby be dissipated via the coolant/engine-oil heat exchanger to the coolant and further via the coolant cooler to the environment. Specifically, in the case of a limited cooling capacity of the air/engine-oil cooler, it is thereby possible by the low temperature coolant and by the pumped coolant quantity to ensure suitable engine oil temperature control.

15 Claims, 1 Drawing Sheet

U.S. PATENT DOCUMENTS

| | | | | |
|---|---|---|---|---|
| 2002/0112679 | A1 | 8/2002 | Langervik | |
| 2002/0128107 | A1* | 9/2002 | Wakayama | 475/161 |
| 2006/0180102 | A1 | 8/2006 | Braun et al. | |

FOREIGN PATENT DOCUMENTS

| | | | |
|---|---|---|---|
| DE | 199 43 002 | C2 | 4/2001 |
| DE | 101 46 313 | A1 | 4/2003 |
| DE | 102 26 928 | A1 | 1/2004 |
| DE | 102 44 829 | A1 | 4/2004 |
| DE | 103 20 746 | A1 | 12/2004 |
| DE | 103 53 298 | A1 | 6/2005 |
| FR | 2 571 431 | A1 | 4/1986 |
| JP | 58106123 | A * | 6/1983 |
| JP | 59218326 | A * | 12/1984 |
| JP | 10238347 | A | 9/1998 |

OTHER PUBLICATIONS

International Search Report dated Jun. 7, 2006 with English translation of relevant portion and PCT/ISA/237 with English translation of relevant portion (Fourteen (14) pages).

German Search Report dated Feb. 14, 2007 with English translation of relevant portion (Nine (9) pages).

* cited by examiner

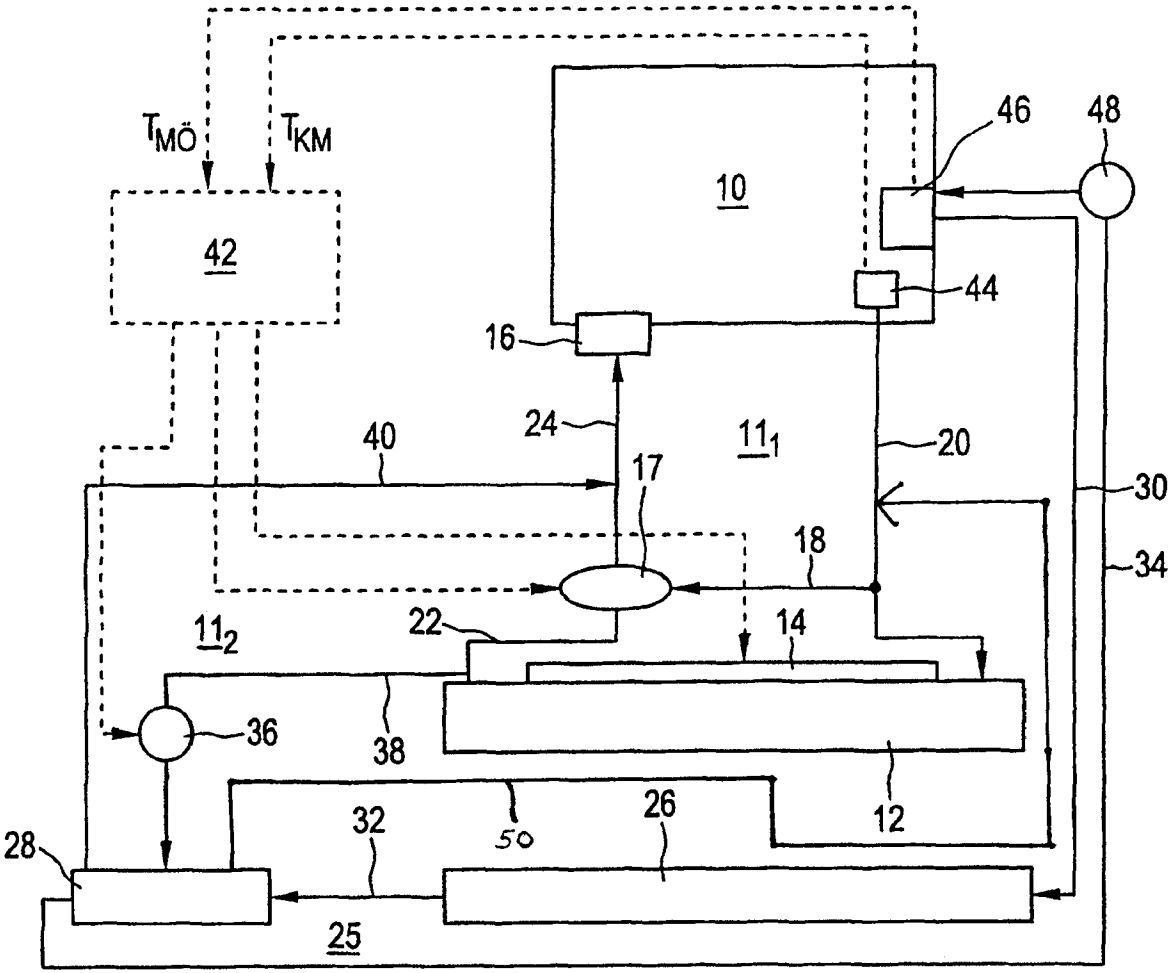
Fig.

SYSTEM AND METHOD FOR CONTROLLING OIL TEMPERATURE OF AN INTERNAL COMBUSTION ENGINE IN A MOTOR VEHICLE

CROSS REFERENCE TO RELATED APPLICATIONS

This application is a 371 National Stage of PCT International Application No. PCT/EP2005/012935, filed Dec. 2, 2005, which claims priority under 35 U.S.C. §119 to German Patent Application No. 10 2004 061 426.1, filed Dec. 21, 2004, the entire disclosures of which are herein expressly incorporated by reference.

BACKGROUND AND SUMMARY OF THE INVENTION

The present invention relates to a system and to a method for controlling the temperature of the engine oil of an internal combustion engine of a motor vehicle.

It is known from the prior art to use an air/engine-oil cooler, which cools the engine oil flowing therein by means of the air flow impinging on its surface, to control the temperature of the engine oil of an internal combustion engine of a motor vehicle. A problem here is that of providing a sufficiently large air impingement face. In the case of high-performance vehicles, the installation space for a correspondingly large air/engine-oil cooler, which is required, is not available.

Furthermore, German patent documents DE 199 43 002 C2, DE 102 26 928 A1 and DE 102 44 829 A1, for example, describe a coolant/engine-oil heat exchanger for controlling the temperature of the engine oil. A part of the coolant for cooling the internal combustion engine of the motor vehicle is branched off from the cooling circuit and is conducted through the coolant/engine-oil heat exchanger in order to control the temperature of the engine oil, which flows through the coolant/engine-oil heat exchanger, by means of an exchange of heat between the coolant and the engine oil. In the case of German patent documents DE 102 26 928 A1 and DE 102 44 829 A1, the coolant is branched off downstream of the internal combustion engine, i.e., the coolant for controlling the temperature of the engine oil is at a relatively high temperature. In addition, the coolant in the known systems is also conducted through the coolant/engine-oil heat exchanger by means of the coolant pump of the cooling circuit. Therefore, regulation of the cooling power of the coolant/engine-oil heat exchanger corresponding to the engine oil temperature is not possible.

An object of the present invention is to provide a system and a method for controlling the temperature of the engine oil of an internal combustion engine of a motor vehicle, which ensure suitable temperature control of the engine oil even in the case of high-performance vehicles with a limited installation space for engine oil cooling devices.

This and other objects and advantages are achieved by a system and a method according to exemplary embodiments of the present invention, including a system for controlling the temperature of the engine oil of an internal combustion engine of a motor vehicle. The system contains an engine oil circuit for controlling the temperature of the engine oil, which engine oil circuit includes the internal combustion engine and a coolant/engine-oil heat exchanger; and a coolant circuit for controlling the temperature of the internal combustion engine, which coolant circuit, in a main branch, includes the internal combustion engine, a coolant cooler and a first coolant pump. The coolant circuit also has an auxiliary branch downstream of the coolant cooler, which auxiliary branch includes the coolant/engine-oil heat exchanger and a second coolant pump.

According to the system of the exemplary embodiments, on the one hand, a coolant which is cooled in the coolant cooler is conducted through the coolant/engine-oil heat exchanger, and on the other hand, a regulable quantity of a coolant is conducted through the second coolant pump. It is hereby possible to control the temperature of the engine oil optimally corresponding to the operating state of the internal combustion engine and a temperature of the engine oil. With the system according to the invention, it is additionally the case that no great amount of installation space is required, for example, for an air/engine-oil cooler with a large air impingement face.

In one embodiment of the invention, the coolant recirculating line of the coolant/engine-oil heat exchanger opens out into the coolant supply line of the main branch upstream of the internal combustion engine. In an alternative embodiment, the coolant recirculating line of the coolant/engine-oil heat exchanger can also be conducted into a coolant recirculating line of the main branch downstream of the internal combustion engine.

In another exemplary embodiment of the invention, a control and regulating unit is also provided, which control and regulating unit controls the operation of the second coolant pump in the auxiliary branch and, in parallel, controls the operation of a fan of the coolant cooler as a function of an engine oil temperature. It is hereby possible for a temperature increase of the coolant on account of the exchange of heat in the coolant/engine-oil heat exchanger to be compensated by an increased cooling power of the coolant cooler. In addition, the control and regulating unit can control the operation of the second coolant pump in the auxiliary branch also as a function of a coolant temperature in order to prevent overheating of the coolant.

In a further embodiment of the invention, the second coolant pump is an electrically driven coolant pump which can be operated independently of the operation of the internal combustion engine and of the first coolant pump in the main branch of the coolant circuit.

In order to improve the capacity for controlling the temperature of the engine oil, the engine oil circuit also contains an air/engine-oil cooler in series with the coolant/engine-oil heat exchanger. The air/engine-oil cooler, however, on account of the above-described coolant/engine-oil heat exchanger, requires only a relatively small air impingement face in comparison with conventional systems, such that it also requires only a relatively small installation space to be made available.

According to a second aspect of the present invention, in a method for controlling the temperature of the engine oil of an internal combustion engine of a motor vehicle, the engine oil is conducted through a coolant/engine-oil heat exchanger, through which a coolant of a coolant circuit for controlling the temperature of the internal combustion engine having a coolant cooler is conducted in order to control the temperature of the engine oil by an exchange of heat between the engine oil and the coolant, in which the coolant which is cooled in the coolant cooler is conducted through the coolant/engine-oil heat exchanger as a function of a temperature of the engine oil.

As already mentioned above, on the one hand, a coolant which is cooled in the coolant cooler is conducted through the coolant/engine-oil heat exchanger, and on the other hand, a regulable quantity of a coolant is conducted through the second coolant pump. It is hereby possible to control the temperature of the engine oil optimally corresponding to the operating state of the internal combustion engine and a temperature of the engine oil. With the system according to the invention, it is additionally the case that no great amount of installation space is required for example for an air/engine-oil cooler with a large air impingement face.

In one embodiment of the invention, the coolant which is cooled in the coolant cooler is conducted through the coolant/engine-oil heat exchanger also as a function of a temperature of the coolant.

In a further embodiment of the method according to the invention, the coolant, after flowing through the coolant/engine-oil heat exchanger, is conducted into a coolant supply line upstream of the internal combustion engine, or alternatively into a coolant recirculating line downstream of the internal combustion engine.

The coolant which is cooled in the coolant cooler may be conducted through the coolant/engine-oil heat exchanger by an electrically driven coolant pump which can be operated independently of the operation of the internal combustion engine and of the first coolant pump in the main branch of the coolant circuit.

It is also possible, after the internal combustion engine is switched off in the event of an overheated coolant, for the coolant to be conducted through the coolant cooler by the electrically driven coolant pump, and at the same time for a fan of the coolant cooler to be operated, in order to avoid boiling of the coolant. The operation of the electrically driven coolant pump and of the fan of the coolant cooler is deactivated after a predetermined time has elapsed in order to conserve the vehicle electrical system voltage.

The engine oil may also be conducted through an air/engine-oil cooler.

The advantages, features and feature combinations described above and further advantages, features and feature combinations can be gathered from the following description of an exemplary embodiment of the invention with reference to the appended drawing.

BRIEF DESCRIPTION OF THE DRAWINGS

The single FIGURE is a schematic illustration of the design of a system for controlling the temperature of the engine oil of an internal combustion engine of a motor vehicle according to the present invention.

DETAILED DESCRIPTION OF THE DRAWINGS

The FIGURE schematically illustrates the design of a system for controlling the temperature of the engine oil of an internal combustion engine according to a preferred but non-restrictive exemplary embodiment of the present invention. For this purpose, the internal combustion engine 10 is connected to a coolant circuit 11 and to an engine oil circuit 25.

The coolant circuit 11 contains a main branch $\mathbf{11}_1$ and an auxiliary branch $\mathbf{11}_2$. The main branch $\mathbf{11}_1$ of the coolant circuit 11 includes, as in conventional systems, the internal combustion engine 10, a coolant cooler 12 and a first coolant pump 16. The coolant (generally engine-cooling water) which is cooled in the coolant cooler 12 by a fan 14 is conducted by the coolant pump 16 through a coolant supply line 22, 24 to the internal combustion engine 10, and the coolant which is heated in the internal combustion engine 10 is recirculated back to the coolant cooler 12 by a coolant recirculating line 20 in order to be cooled again.

In order, for example in the event of a cold start of the internal combustion engine 10, to bring the internal combustion engine 10 up to the optimum operating temperature as fast as possible, a bypass line 18 is also provided in the main branch $\mathbf{11}_1$ of the coolant circuit 11, through which bypass line 18 the coolant in the coolant recirculating line 20 is conducted past the coolant cooler 12, without being cooled, via the coolant supply line 24, and directly back into the internal combustion engine 10. In order to set the flow quantities of the coolant flowing through the coolant cooler 12 and of the coolant flowing through the bypass line 18, a regulating valve, for example a two-way valve, is arranged in a known way in the coolant supply line 22, 24.

Although not illustrated, the main branch $\mathbf{11}_1$ of the coolant circuit 11 of the internal combustion engine 10 can also contain, in a known way, an equalizing tank, a coolant/transmission-oil heat exchanger, various pressure and temperature sensors, regulating valves and the like.

In the system according to the invention, the coolant circuit 11 also contains an auxiliary branch $\mathbf{11}_2$ downstream of the coolant cooler 12. The auxiliary branch $\mathbf{11}_2$ of the coolant circuit 11 includes a second coolant pump 36 and a coolant/engine-oil heat exchanger 28. The coolant which is cooled in the coolant cooler 12 flows via the second coolant pump 36 through a coolant supply line 38 into the coolant/engine-oil heat exchanger 28 and is conducted back, via a coolant recirculating line 40 of the auxiliary branch $\mathbf{11}_2$, into the main branch $\mathbf{11}_1$ of the coolant circuit 11.

In the illustrated exemplary embodiment, the coolant recirculating line 40 of the auxiliary branch $\mathbf{11}_2$ opens out into the coolant supply line 24 of the main branch $\mathbf{11}_1$ upstream of the internal combustion engine 10. In an alternative embodiment, the coolant be is guided from the coolant/engine-oil heat exchanger 28 via the coolant recirculating line 50 of the auxiliary branch $\mathbf{11}_2$ into the coolant recirculating line 20 of the main branch $\mathbf{11}_1$ of the coolant circuit 11 downstream of the internal combustion engine 10 to be conducted past the internal combustion engine 10.

While the first coolant pump 16 in the main branch $\mathbf{11}_1$ of the coolant circuit is, for example, a pump that is driven by an output drive of the internal combustion engine 10, an electrically driven pump, which is fed from the vehicle electrical system or the battery of the motor vehicle, may be used as a second coolant pump 36 in the auxiliary branch $\mathbf{11}_2$ of the coolant circuit 11. The operation of the second coolant pump 36 can hereby be controlled independently of the operating state (on/off) of the internal combustion engine 10.

A control and regulating unit 42 is provided for controlling the second coolant pump 36 and the fan 14 of the coolant cooler 12. The control and regulating unit 42 is supplied with inter alia a coolant temperature $T_{KM}$ measured by a coolant temperature sensor 44, and an engine oil temperature $T_{M\ddot{O}}$ measured by an engine oil temperature sensor 46, as inputs. The coolant temperature sensor 44 and the engine oil temperature sensor 46 measure the coolant temperature $T_{KM}$ and engine oil temperature $T_{M\ddot{O}}$ preferably at the outlet of the internal combustion engine 10.

The already-mentioned engine oil circuit 25 includes the internal combustion engine 10, an air/engine-oil cooler 26 and the coolant/engine-oil heat exchanger 28. The engine oil is initially cooled in the air/engine-oil cooler 26 by an air flow and is then output via an engine oil line 32 to the coolant/engine-oil heat exchanger 28. In the coolant/engine-oil heat exchanger 28, the engine oil in the engine oil circuit 25 is in heat-exchanging contact with the coolant in the auxiliary branch $\mathbf{11}_2$ of the coolant circuit 11, and can thereby be cooled during operation of the second coolant pump 36. The engine oil which is cooled in the air/engine-oil cooler 26 and in the coolant/engine-oil heat exchanger 28 is fed by a pump device 48 via an engine oil supply line 34 to the internal combustion engine 10. The engine oil which is heated in the internal combustion engine 10 is recirculated back to the air/engine-oil cooler 26 via an engine oil recirculating line 30.

On account of the coolant/engine-oil heat exchanger 28, it is possible for the air/engine-oil cooler 26 to be of smaller dimensions or even to be omitted entirely. As described below, it is however possible at all times, in particular even at high load states of the internal combustion engine 10, to ensure suitable temperature control of the engine oil.

The mode of operation of the above-described system for controlling the temperature of the engine oil of the internal combustion engine 10 will now be explained with reference to the FIGURE. The mode of operation of the main branch $11_1$ of the coolant circuit 11 corresponds here to that of conventional systems, and will therefore not be described in any more detail in the context of this invention.

In normal operation of the internal combustion engine 10, the second coolant pump 36 is switched off, so that no coolant flows through the auxiliary branch $11_2$ of the coolant circuit 11. The engine oil is therefore cooled only by the air/engine-oil cooler 26. If the engine oil temperature $T_{MÖ}$ measured by the engine oil temperature sensor 46 exceeds a first limit value (for example, 120° C.), then the control and regulating unit 42 switches on the second coolant pump 36. A part of the coolant which is cooled in the coolant cooler 12 is hereby conducted through the coolant/engine-oil heat exchanger 28, and the coolant absorbs heat from the engine oil. The dissipation of the absorbed heat to the environment then takes place by means of the coolant cooler 12. If the engine oil temperature $T_{MÖ}$ measured by the engine oil temperature sensor 46 falls below a second limit value (for example, 115° C.) which is the same as or less than the upper, first limit value, then the control and regulating unit 42 switches the second coolant pump 36 off again.

At the same time as or a slight time delay after the second coolant pump 36 is switched on, the control and regulating unit 42 also activates the fan 14 of the coolant cooler 12 such that the rotational speed of the cooler 14 is increased, i.e., the cooling power of the coolant cooler 12 is increased. This measure ensures that the heat absorbed from the engine oil can be dissipated from the coolant to the environment.

The control and regulating unit may also be supplied with the coolant temperature $T_{KM}$ measured by the coolant temperature sensor 44. If the coolant temperature $T_{KM}$ exceeds an upper limit value, the control and regulating unit 42 cam switch off the second coolant pump 36, and thereby end the absorption of heat from the engine oil, in order to prevent overheating of the coolant and therefore of the internal combustion engine 10.

The control actions of the second coolant pump 36 and of the fan 14 of the coolant cooler 12 by the control and regulating unit 42 are normally carried out as a function of load, i.e., more or less cooling of the coolant and of the engine oil is required depending on the driving state and driving speed of the motor vehicle.

With the system described above, suitable temperature control of the engine oil can be ensured at all times, even if the air/engine-oil cooler 26 is of relatively small dimensions, i.e., has a relatively small air impingement face, or the airflow impinging on the air/engine-oil cooler 26 is restricted on account of the driving state of the motor vehicle (e.g., driving up-hill, air stream from the side or from the rear). The coolant which is cooled in the coolant cooler 12 is utilized for the exchange of heat between the engine oil and the coolant, and the flow quantity of the coolant which is provided for the exchange of heat is regulated optimally by the second coolant pump 36.

With the above-described system, it is possible for a further advantageous operating mode to be implemented, as is described below.

If the internal combustion engine 10 is switched off, for example, when parking the motor vehicle, and at the same time the coolant is very hot (for example $T_{KM}$>118° C.), it is possible to effectively prevent boiling of the coolant in the coolant circuit 11. Although the first coolant pump 16 in the main branch $11_1$ of the coolant circuit 11 is switched off together with the internal combustion engine 10, the control and regulating unit 42 can cause a coolant flow through the coolant cooler 12 by means of the second coolant pump 36. The regulating valve 17 in the coolant supply line 22, 24 from the coolant cooler 12 to the internal combustion engine 10 prevents the coolant from circulating only through the auxiliary branch $11_2$ of the coolant circuit 11. The coolant is cooled by the simultaneous switching-on of the fan 14 of the coolant cooler 12.

After a coolant temperature $T_{KM}$ of, for example, 110° C. has been reached, or after a predetermined time duration of for example, 10 minutes has elapsed, the second coolant pump 36 and the fan 12 of the coolant cooler 12 are switched off again by the control and regulating unit 42 in order that the vehicle electrical system is not overloaded.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

The invention claimed is:

1. A system for controlling the temperature of the engine oil of an internal combustion engine of a motor vehicle, comprising:

an engine oil circuit for controlling the temperature of the engine oil, said engine oil circuit including a first portion of the internal combustion engine and a coolant/engine-oil heat exchanger;

a coolant circuit for controlling the temperature of the internal combustion engine, said coolant circuit, in a main branch, including a second portion of the internal combustion engine, a coolant cooler and a first coolant pump, said coolant circuit also including an auxiliary branch downstream of the coolant cooler, said auxiliary branch including the coolant/engine-oil heat exchanger and a second coolant pump; and a control and regulating unit that controls operation of the second coolant pump in the auxiliary branch as a function of engine oil temperature;

wherein a coolant recirculating line of the coolant/engine-oil heat exchanger opens out into a coolant supply line of the main branch upstream of the internal combustion engine or a coolant recirculating line of the main branch downstream of the internal combustion engine; and wherein the control and regulating unit which controls the operation of the second coolant pump in the auxiliary branch controls, in parallel, the operation of a fan of the coolant cooler as a function of an engine oil temperature.

2. The system as claimed in claim 1, wherein the control and regulating unit controls the operation of the second coolant pump in the auxiliary branch also as a function of a coolant temperature.

3. The system as claimed in claim 1, wherein the second coolant pump is an electrically driven coolant pump.

4. The system as claimed in claim 1, wherein the engine oil circuit also includes an air/engine-oil cooler in series with the coolant/engine-oil heat exchanger.

5. A method for controlling the temperature of the engine oil of an internal combustion engine of a motor vehicle, said method comprising:

controlling the temperature of the engine oil by an engine oil circuit, including a first portion of the internal combustion engine and a coolant/engine-oil heat exchanger;

conducting the engine oil through the coolant/engine-oil heat exchanger, through which a coolant of a coolant circuit for controlling the temperature of the internal combustion engine having a coolant cooler is conducted, in order to control the temperature of the engine oil via an exchange of heat between the engine oil and the coolant, said coolant circuit including, in a main branch, a second portion of the internal combustion engine, a coolant cooler and a first coolant pump, and, in an auxiliary branch downstream of the coolant cooler, the coolant/engine-oil heat exchanger and a second coolant pump; and controlling operation of the second coolant pump by a control and regulating unit as a function of engine oil temperature;

wherein the coolant which is cooled in the coolant cooler is conducted through the coolant/engine-oil heat exchanger as a function of the temperature of the engine oil;

wherein a coolant recirculating line of the coolant/engine-oil heat exchanger opens out into a coolant supply line of the main branch upstream of the internal combustion engine or a coolant recirculating line of the main branch downstream of the internal combustion engine; and wherein the control and regulating unit which controls the operation of the second coolant pump in the auxiliary branch controls, in parallel, the operation of a fan of the coolant cooler as a function of an engine oil temperature.

6. The method as claimed in claim 5, wherein the coolant which is cooled in the coolant cooler is conducted through the coolant/engine-oil heat exchanger also as a function of a temperature of the coolant.

7. The method as claimed in claim 6, wherein the coolant, after flowing through the coolant/engine-oil heat exchanger, is conducted into a coolant supply line upstream of the internal combustion engine.

8. The method as claimed in claim 6, wherein the coolant, after flowing through the coolant/engine-oil heat exchanger, is conducted into a coolant recirculating line downstream of the internal combustion engine.

9. The method as claimed in claim 6, wherein the coolant which is cooled in the coolant cooler is conducted through the coolant/engine-oil heat exchanger via an electrically driven coolant pump.

10. The method as claimed in claim 5, wherein the coolant, after flowing through the coolant/engine-oil heat exchanger, is conducted into a coolant supply line upstream of the internal combustion engine.

11. The method as claimed in claim 5, wherein the coolant, after flowing through the coolant/engine-oil heat exchanger, is conducted into a coolant recirculating line downstream of the internal combustion engine.

12. The method as claimed in claim 5, wherein the coolant which is cooled in the coolant cooler is conducted through the coolant/engine-oil heat exchanger via an electrically driven coolant pump.

13. The method as claimed in claim 12, wherein, after the internal combustion engine is switched off, the coolant is conducted through the coolant cooler via—the electrically driven coolant pump, and a fan of the coolant cooler is operated, as a function of the coolant temperature.

14. The method as claimed in claim 13, wherein the operation of the electrically driven coolant pump and of the fan of the coolant cooler is deactivated after a predetermined time has elapsed.

15. The method as claimed in claim 5, wherein the engine oil is also conducted through an air/engine-oil cooler.

* * * * *